US005293843A

United States Patent [19]

Provol et al.

[11] Patent Number: 5,293,843

[45] Date of Patent: Mar. 15, 1994

[54] COMBUSTOR OR GASIFIER FOR APPLICATION IN PRESSURIZED SYSTEMS

[75] Inventors: Steven J. Provol; David Russell, both of San Diego, Calif.

[73] Assignee: A. Ahlstrom Corporation, Noormarkku, Finland

[21] Appl. No.: 987,721

[22] Filed: Dec. 9, 1992

[51] Int. Cl.[5] ..... F22B 1/00

[52] U.S. Cl. ..... 122/4 D; 110/245; 165/104.16; 422/146

[58] Field of Search ..... 122/4 D; 165/104.16; 431/7; 110/245; 422/146, 141, 142

[56] References Cited

U.S. PATENT DOCUMENTS 4,730,452 3/1988 Källman ..... 122/4 D X
5,146,856 9/1992 George ..... 122/4 D X

FOREIGN PATENT DOCUMENTS 2016122 9/1979 United Kingdom .
2016123 9/1979 United Kingdom .

*Primary Examiner*—Edward G. Favors
*Attorney, Agent, or Firm*—Nixon & Vanderhye

[57] ABSTRACT

A fluidized bed combustor or gasifier has a combustion chamber(s) with a non-symmetrical horizontal cross section. The chamber may be trapezoidal, hemispherical, or may have five or more side walls of at least two different lengths. The walls of the combustion chamber may be water tube panels. An external pressure vessel surrounds the combustion chamber(s) and associated particle separator(s), and may be spherical or cylindrical.

23 Claims, 4 Drawing Sheets

COMBUSTOR OR GASIFIER FOR APPLICATION IN PRESSURIZED SYSTEMS

BACKGROUND AND SUMMARY OF THE INVENTION

The present invention relates to a circulating fluidized bed combustor or gasifier for application in pressurized combustion or gasification systems, the systems comprising at least one upright combustion chamber and one particle separator connected thereto enclosed in a common external upright pressure vessel.

In conventional circulating fluidized bed processes high flow velocity and excellent mixing of particles and gases leads to efficient heat transfer and improved combustion efficiency. SO2 and NOx emissions are low due to desulphurizing sorbents used and due to staged combustion. Various fuels and refuse derived wastes may be burned or gasified and utilized in circulating fluidized bed combustion. The temperature is very stable and the heat transfer rate is high.

In pressurized circulating fluidized bed processes principally all advantages from atmospheric circulating fluidized bed processes are maintained, whereas some additional advantages are achieved.

The size of a pressurized steam generation plant, including combustion chamber and particle separators, can be made much smaller than a corresponding conventional atmospheric steam generation plant. Significant savings in material and investment costs are achieved.

Further pressurized steam generation systems provide increased total efficiency compared to atmospheric steam boilers. Pressurizing of a circulating fluidized bed process provides a considerable increase in efficiency/-volume ratio.

In pressurized circulating fluidized bed systems fuel is combusted or gasified in a combustion chamber at high temperatures and high pressure. The external vessel provides pressure containment, which is cooled or insulated to enhance material strength and to thereby minimize costs of the pressure vessel. Combustion air pressurized in a compressor is directed into the pressure vessel into the space between the combustor and the peripheral wall of the pressure vessel. The pressurized air thereby provides for cooling of the walls of the pressure vessel. In the vessel the pressurized air is further directed through a grid into the combustion chamber for fluidizing and combusting of material therein. The pressure in the pressure vessel may be 8–30 bar, typically 10–14 bar.

In a circulating fluidized bed system particles are separated in a particle separator, such as a cyclone or hot gas filter, from the hot gases produced in the combustion chamber and the separated particles are recycled into the combustion chamber. In a combined gas/-steam power plant the hot gases discharged from the particle separator may be further cleaned and utilized in a gas turbine, thereby increasing the electrical efficiency of the power plant considerably compared with a conventional steam generation plant. The gas turbine may be connected to the compressor feeding pressurized air into the combustor.

The peripheral walls of the combustion chamber are cooled by recovering heat in a water/steam circulation. Additional heating surfaces, such as superheaters, reheaters and economizers, connected to the water/steam circulation are usually arranged in the combustion chamber. In circulating fluidized bed combustors the additional heating surfaces are arranged in the upper part of the combustion chamber. A multitude of steam piping, including risers and downcomers, thereby have to be arranged within the pressure vessel. Steam generation systems for power plants are therefore large even if pressurized.

The external pressure vessel can be a variety of shapes. Two common shapes are cylindrical and spherical. The price of a pressure vessel itself is high and the space inside the vessel must be utilized as advantageously as possible. The diameter of the pressure vessel should be kept as small as possible to minimize costs. The vessel wall thickness and hence material costs increase with the diameter of the vessel.

When pressurizing a circulating fluidized bed combustor system all of the combustion chamber, particle separator, fuel feeding and ash discharge arrangements, as well as the piping for the water/steam circulation are preferably arranged in one single pressure vessel. A conventional combustion chamber, having a square, rectangular or circular cross section, leads to a very space consuming arrangement, which needs a large diameter pressure vessel, leaving a large volume of unused space in the vessel.

The cost of the pressure vessel is a determining factor when calculating the total costs of the pressurized system. The bigger the system the more significant is the price of the pressure vessel.

It is therefore an object of the present invention to provide a pressurized circulating fluidized bed combustion or gasification system in which the size of the pressure vessel is minimized. This is achieved, according to the present invention, by utilizing in the pressurized combustion or gasification system a combustion chamber comprising a nonsymmetrical horizontal cross section, whereby at least two adjacent walls in the combustion chamber form an angle $> 90°$, or the horizontal cross section of the combustion chamber is hemispherical.

The arrangement of combustion chamber equipment within the pressure vessel together with related auxiliary equipment including cyclones, filters, steam piping, fuel feeding or other equipment can be enhanced by utilizing unconventional combustion chamber shapes. According to the present invention a trapezoidal, semi-cylindrical, hybrid trapezoidal/semi-cylindrical, or other semicylindrical-approaching multisided (e.g. five or more sides) polygonal cross section is provided to better conform the shape of the combustor to the external vessel.

Advantages of the combustion chamber cross section of the invention include:

Optimal utilization of plan area within the external pressure vessel, thereby minimizing the size, cost, and space requirements of the vessel.

Minimization of the height of the combustor or gasifier, and of the external pressure vessel, by alternative configurations of the heat transfer surfaces. Such configurations include angling internal surfaces and maximizing wall area per unit height.

Maximization of the perimeter area of the combustor or gasifier, enhancing circulation characteristics of the combustor or gasifier if it is cooled.

Optimizing the cross sectional area of the combustor or gasifier, increasing the amount of usable space for location of heat transfer surfaces.

Reducing the potential effects of erosion by increasing the angle and/or rounding edges and corners within the combustor or gasifier to reduce eddies.

Increased wall area on the rear combustor wall for location of cyclone inlets, solids feeding or removal, and heat transfer surfaces.

DETAILED DESCRIPTION OF THE DRAWINGS

Figure 1:
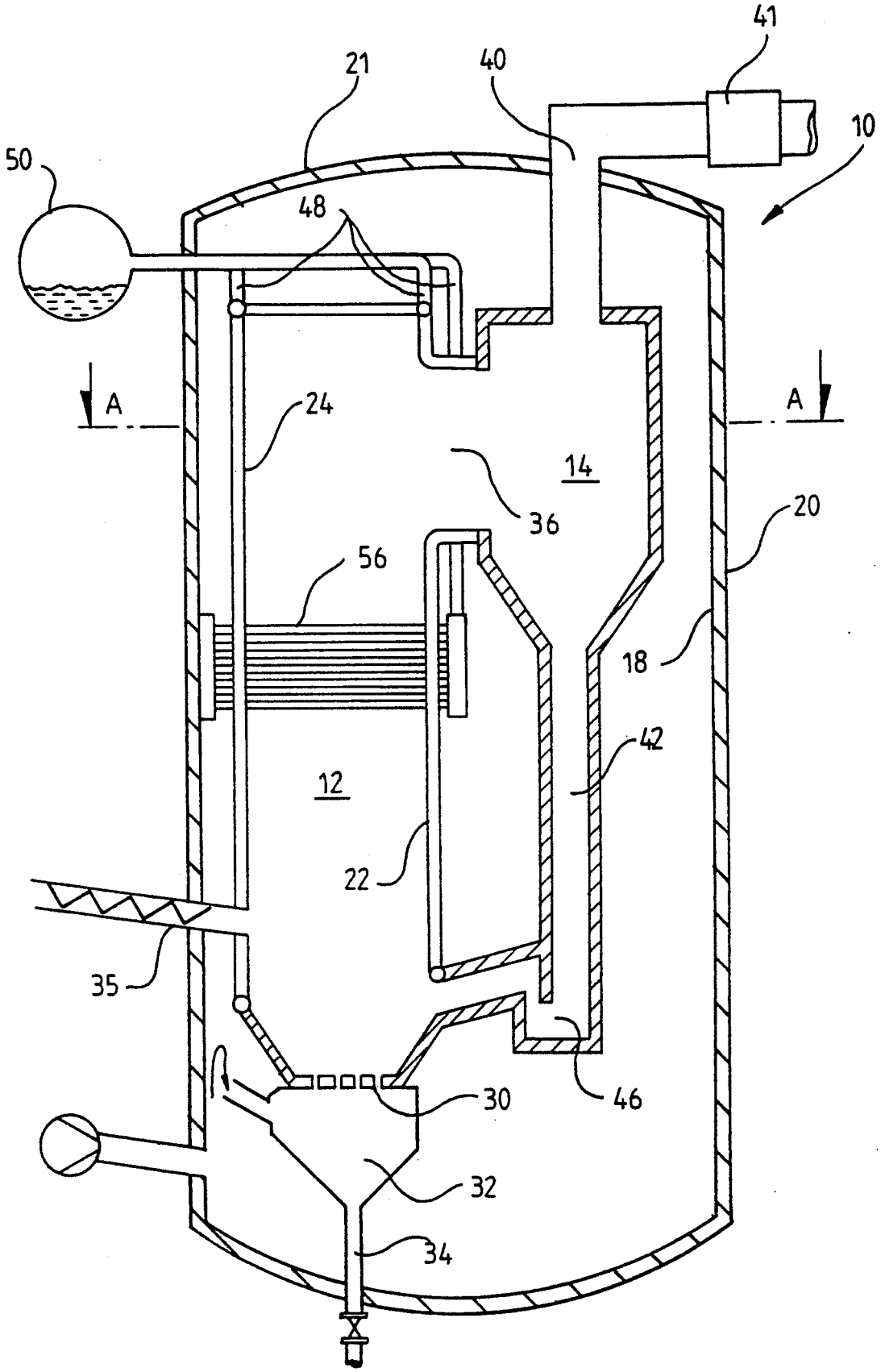
FIG. 1 is a schematical vertical section of a pressurized combustor having an exemplary trapezoidal cross sectional combustion chamber in accordance with the invention arranged in a pressure vessel.
Figure 2:
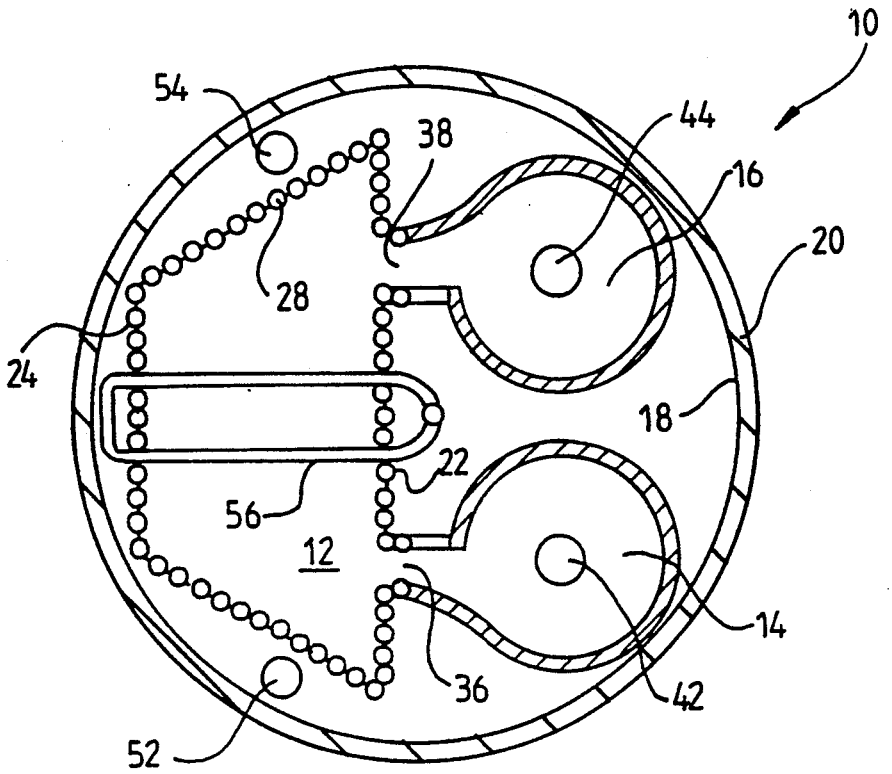
FIG. 2 is a cross sectional view taken along lines AA of the pressurized combustor of FIG. 1.

The pressurized fluidized bed combustor shown in FIGS. 1 and 2 comprises a pressure vessel 10 having a combustion chamber 12 and two cyclone separators 14 and 16 arranged therein. The pressure vessel is formed of an upright cylindrical steel vessel 18 with external insulation 20 and a flanged cover plate 21 on top.

The combustion chamber 12 has a trapezoidal cross section, and is mainly made of vertical planar tube panels forming a longest side wall 22, a short side wall 24 and two end walls 26 and 28. Of course in such a polygon at least two adjacent substantially straight walls form an angle 7 ninety degrees. The combustion chamber 12 is arranged in a first half of the pressure vessel, the long side wall or back wall 22 being arranged approximately in the middle part of the vessel 18 and the short side wall or front wall 24 and the end walls 26 and 28 being arranged close to the periphery of the pressure vessel 18. This provides a very space efficient arrangement of the combustion chamber 12, and cyclones 14, 16 and minimizes useless space in the first half of the pressure vessel 18. Further the total peripheral tube panel area is increased compared to systems where a rectangular or square combustion chamber with the same plan area is arranged in a similar pressure vessel.

The lower end of the combustion chamber 12 is connected through a grid bottom 30 with a windbox 32 for introducing fluidizing and combustion air into the combustion chamber 12. An ash drain 34 is connected to the windbox 32 for discharging ash from the combustor 10. A fuel feeder 35 is connected to the combustion chamber 12 through the front wall 24. Fuel feeding means like feeder 35 may also be arranged on the back wall if that is more convenient.

The upper part of the combustion chamber 12 is connected through two gas ducts 36 and 38 to cyclones 14 and 16 arranged mainly in the second half of the pressure vessel and adjacent the back wall. The cyclones 14, 16 have gas outlets 40 for discharging gas from the combustor 10, e.g. to a hot gas filter 41 or to a convection section (not shown). The cyclones 14, 16 are connected through return ducts 42 and 44 and loop seals 46 with the lower part of the combustion chamber 12.

The tube walls 22, 24, 26, 28 of the combustion chamber 12 are connected through headers 48 with a steam drum 50. Downcomers 52 and 54 connecting the steam drum 50 with the lower end of tube panel walls (e.g. 22, 24) are arranged adjacent to the end walls (26, 28) of the combustion chamber 12. Additional heat transfer panels 56, e.g. superheaters, may easily be arranged in the combustion chamber 12, as the present invention provides enough space in the pressure vessel 18 for steam piping and other auxiliary equipment and ample space for additional heat transfer surfaces inside the combustion chamber.

Figure 3:
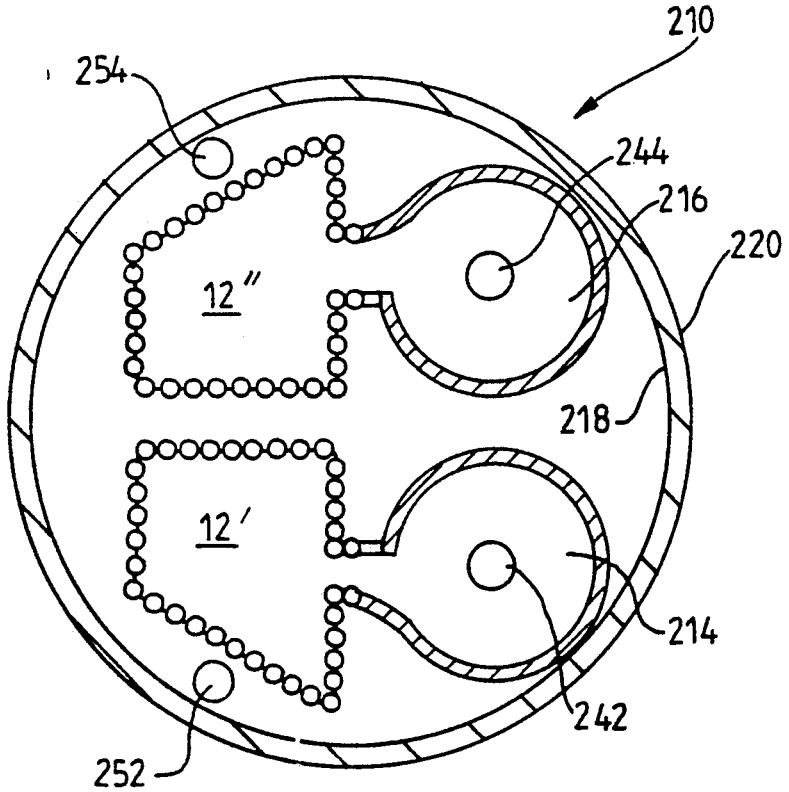
FIG. 3 is a cross sectional view of another exemplary combustor system having two combustion chambers arranged in one single pressure vessel.

In FIG. 3 components comparable to those in FIG. 2 are shown by the same reference numeral only preceded by a "1". The combustion chamber may as shown in FIG. 3 be divided into two separate combustion chambers 12' and 12", thereby increasing the heat transfer surface area additionally, both chambers 12', 12" being trapezoidal in cross section.

Figure 4:
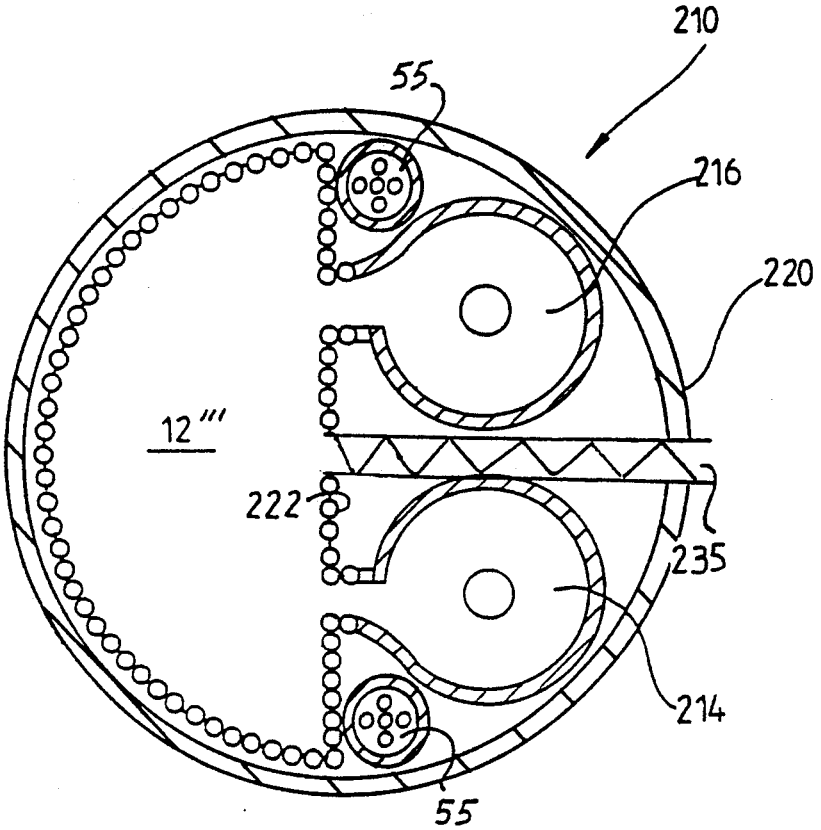
FIG. 4 is a cross sectional view of still another exemplary pressurized combustor system having a hemispherical combustion chamber arranged in the pressure vessel.

In FIG. 4 components comparable to those in FIG. 2 are shown by the same reference numeral only preceded by a "2". The combustion chamber may, if desired, have a hemispherical cross section, as shown in FIG. 4. A hemispherical combustion chamber, like the chamber 12'", can almost completely fill the first half of the pressure vessel 218 leaving substantially no useless space between the pressure vessel 218 and the combustion chamber 12'". A fuel feeder 235 is illustrated schematically in FIG. 4, it being understood that the fuel feeder 235 will typically be located at the same level with respect to the chamber 12'" as the fuel feeder 35 is with respect to the chamber 12 in FIG. 1. Also, a filter 55 may be provided connected to a gas outlet of the particle separator, the filter being disposed adjacent the planar wall 222.

Figure 5:
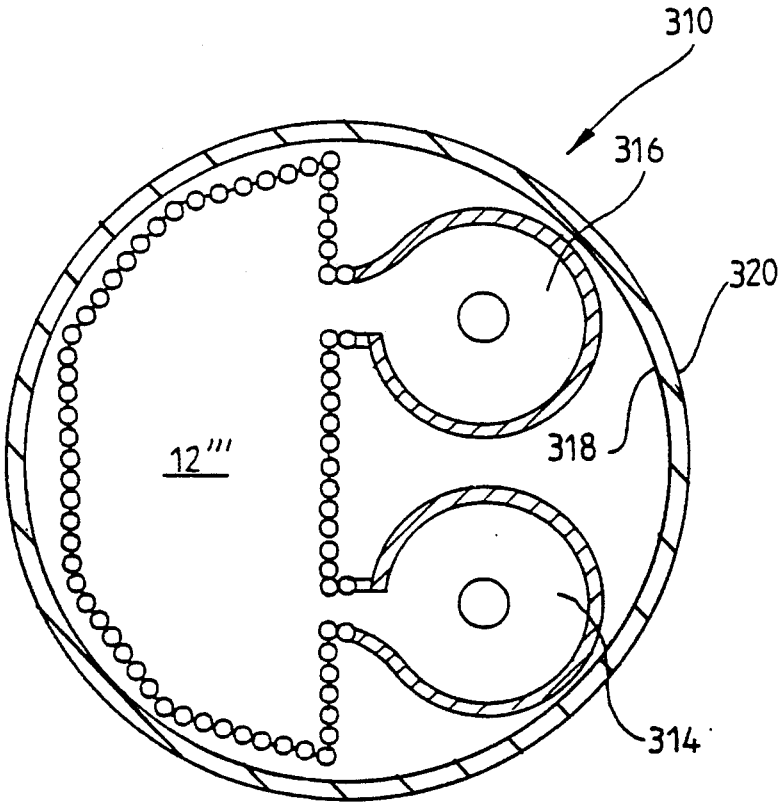
FIG. 5 is a view like that of FIG. 4 only of an embodiment having straight walls (i.e. a multi-sided polygon), approximating a curved wall of the combustion chamber.
Figure 6:
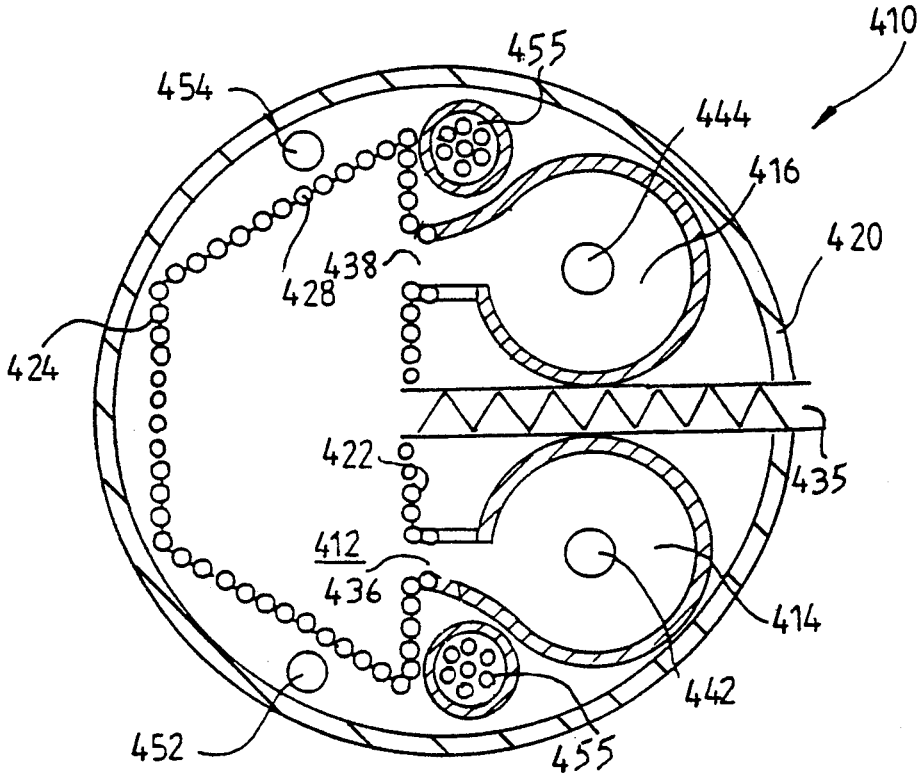
FIG. 6 is a view like that of FIG. 4 only of an embodiment having a trapezoidal cross-sectional configuration of combustion chamber.

In FIG. 5 components comparable to those in FIG. 2 are shown by the same reference numeral only preceded by a "3". A combustion chamber that almost completely fills the first half of the pressure vessel 318 may, on the other hand, also be constructed from flat panel walls, as shown in FIG. 5. Then the cross section of the combustion chamber is a multisided polygon, having five or more side walls (e.g. six walls in the embodiment illustrated).

Thus, the present invention provides a very flexible combustion chamber configuration, with a combustion chamber having four or more walls.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. A fluidized bed combustor or gasifier for application in pressurized systems comprising: at least one upright combustion chamber and at least one particle separator connected thereto and enclosed in a common external upright pressure vessel; and said combustion chamber having a nonsymmetrical horizontal cross section, wherein at least two adjacent substantially straight walls of said combustion chamber form an angle >90°.

2. A combustor or gasifier according to claim 1, wherein said external pressure vessel is cylindrical or spherical.

3. A combustor or gasifier according to claim 1, wherein said walls of said combustion chamber are made of water tube panels.

4. A combustor or gasifier according to claim 1, wherein said horizontal cross section of said combustion chamber is trapezoidal.

5. A combustor or gasifier according to claim 4, wherein said trapezoidal combustion chamber has a longest wall, and wherein at least one particle separator is connected to said longest wall of said trapezoidal combustion chamber.

6. A combustor or gasifier according to claim 5, wherein two adjacent particle separators are connected to said longest wall of said combustion chamber.

7. A combustor or gasifier according to claim 5, further comprising means for feeding fuel into said combustion chamber, said means being connected to said longest wall of said combustion chamber.

8. A combustor or gasifier according to claim 5, wherein steam piping, including risers and downcomers, is disposed adjacent said longest wall of said combustion chamber.

9. A combustor or gasifier according to claim 5, wherein said trapezoidal combustion chamber has two parallel walls; and further comprising a filter connected to a gas outlet of said particle separator, said filter being disposed adjacent one of said two parallel walls.

10. A combustor or gasifier according to claim 4, wherein two combustion chambers having trapezoidal horizontal cross sections are arranged side by side in said pressure vessel, each having a longest wall; and wherein a particle separator is connected to said longest wall of each combustion chamber.

11. A fluidized bed combustor or gasifier for application in pressurized systems comprising at least one upright combustion chamber and at least one particle separator connected thereto and enclosed in a common external upright pressure vessel; and said combustion chamber having a nonsymmetrical horizontal cross section, that is hemispherical.

12. A combustor or gasifier according to claim 11, wherein the combustion chamber includes a planar upright wall and a semicircular upright wall.

13. A combustor or gasifier according to claim 12, wherein at least one particle separator is connected to the planar wall of said combustion chamber.

14. A combustor or gasifier according to claim 12, wherein two adjacent particle separators are connected to the planar wall of said combustion chamber.

15. A combustor or gasifier according to claim 12, further comprising means for feeding fuel into said combustion chamber, said means connected to the planar wall of said combustion chamber.

16. A combustor or gasifier according to claim 12, wherein steam piping, including downcomers and risers, is disposed adjacent to the planar wall of said combustion chamber.

17. A combustor or gasifier according to claim 12, further comprising a filter connected to a gas outlet of the particle separator, said filter being disposed adjacent to the planar wall of said combustion chamber.

18. A combustor or gasifier according to claim 11, wherein said external pressure vessel is cylindrical or spherical.

19. A combustor or gasifier according to claim 11, wherein said combustion chamber has walls that are made of water tube panels.

20. A combustor or gasifier according to claim 11, wherein the fluidized bed is a circulating fluidized bed.

21. A combustor or gasifier according to claim 1, wherein the cross section of said combustion chamber is a multi-sided polygon, having five or more side walls, the side walls being of at least two different lengths.

22. A combustor or gasifier according to claim 21, wherein a first of said side walls is longer than at least some other side wall; and wherein said particle separator is arranged adjacent to said first side wall.

23. A combustor or gasifier according to claim 1, further comprising a filter connected to a gas outlet of the particle separator.

* * * * *